US005941517A

United States Patent [19]

Heiber et al.

[11] Patent Number: 5,941,517

[45] Date of Patent: Aug. 24, 1999

[54] METHOD AND APPARATUS FOR DECOLLATING STACKED BLANKS

[76] Inventors: Wolfgang Heiber, Überhaan 16; Julius Schröder-Frerkes, Trills 110, both of 40699 Erkrath, Germany

[21] Appl. No.: 08/942,850

[22] Filed: Oct. 2, 1997

[30] Foreign Application Priority Data

Oct. 4, 1996 [DE] Germany ..... 196 40 963

[51] Int. Cl.[6] ..... B65H 5/00

[52] U.S. Cl. ..... 271/10.03; 271/270; 271/265.01; 414/797.6

[58] Field of Search ..... 271/10.02, 10.03, 271/10.07, 10.08, 265.01, 270, 35; 414/796.7; 493/222

[56] References Cited

U.S. PATENT DOCUMENTS

| | | | |
|---|---|---|---|
| 3,614,853 | 10/1971 | Seragnoli . | |
| 4,413,984 | 11/1983 | Alter | 493/222 |
| 4,657,236 | 4/1987 | Hirakawa et al. | 271/10.03 |
| 4,673,175 | 6/1987 | Morita | 271/10.03 |
| 4,787,620 | 11/1988 | Goldkuhle | 271/10.03 |
| 5,103,733 | 4/1992 | Drapatsky et al. . | |
| 5,112,038 | 5/1992 | Dunaway | 271/10.03 |
| 5,129,641 | 7/1992 | Long | 271/10.03 |
| 5,295,677 | 3/1994 | Hutner | 271/10.03 |
| 5,423,527 | 6/1995 | Tranquilla | 271/10.02 |
| 5,711,518 | 1/1998 | Portaro et al. | 271/10.03 |

FOREIGN PATENT DOCUMENTS

| | | | |
|---|---|---|---|
| 2111057 | 9/1972 | Germany . | |
| 2145273 | 3/1973 | Germany . | |
| 2230421 | 1/1974 | Germany . | |
| 2758007 | 3/1979 | Germany . | |
| 2946426 | 5/1981 | Germany . | |
| 3811988 | 10/1988 | Germany . | |
| 4001120 | 7/1991 | Germany . | |
| 195 20 342 | 12/1995 | Germany . | |
| 186089 | 7/1993 | Japan | 271/10.02 |
| 373945 | 10/1958 | Switzerland . | |
| 2237797 | 5/1991 | United Kingdom | 271/10.02 |

*Primary Examiner*—James W. Keenan
*Assistant Examiner*—Douglas Hess
*Attorney, Agent, or Firm*—Friedrich Kueffner

[57] ABSTRACT

A method and an apparatus for decollating blanks of cardboard or the like stacked behind a stop in a feeding station from a magazine or stack of blanks and for feeding the blanks to a transfer station of a subsequent process operated in a machine cycle, wherein the apparatus includes at least one delivery conveyor arranged underneath the stack of blanks, and wherein the delivery conveyor includes a conveyor belt and a belt guide for the controlled removal of the respectively lowermost blank and for conveying the blank to the timed subsequent process. The transfer station of the subsequent process controls the speed of the delivery conveyor which operates without fixed cycle.

10 Claims, 2 Drawing Sheets

METHOD AND APPARATUS FOR DECOLLATING STACKED BLANKS

BACKGROUND OF THE INVENTION

1. Field of the Invention

The present invention relates to a method, the use of the method and an apparatus for decollating blanks of cardboard or the like stacked behind a stop means in a feeding station from a magazine or stack of blanks. The apparatus includes at least one delivery conveyor arranged underneath the stack of blanks, wherein the delivery conveyor includes a conveyor belt and a belt guide means for the controlled removal of the respectively lowermost blank and for conveying the blank to a timed subsequent process with a transfer station.

2. Description of the Related Art

In the field of cardboard processing, particularly the processing of folding boxes, it is frequently required to decollate cardboard blanks of all types from a stack in a machine cycle-dependent manner. In addition to decollating in dependance on a machine cycle, decollating in a manner which is not cycle-dependent is also known in the art.

Decollating in dependance on a machine cycle is always required if the decollating step is followed by processing steps which are carried out in dependence on a cycle. A large number of devices and methods are known in the art for this purpose. Economically useful today are only those devices and methods which ensure a continuous refilling of the stack to be decollated.

However, as compared to decollating which is not dependant on machine cycles, all known methods are at a disadvantage with respect to speed because the means for carrying out decollating in dependance on a machine cycle always requires a certain cyclically returning time.

The following devices and methods are known in the field of decollating cardboard blanks in dependance on a machine cycle and are used today in speed-oriented processing:

(a) Rotary Disk Feeder

Rotary disk feeders have the disadvantage that the decollating element (the upper or carrying rubber element) acts in accordance with the cycle of the machine and, thus, always acts on the blank in accordance with the machine conveyor speed. Moreover, refilling of the magazine poses problems because the blanks must be supplied to the respective end of the stack in a manually prescaled configuration.

(b) Rotary suction feeder

Depending on the embodiment of the rotary suction feeder, the decollating element can be somewhat delayed relative to the machine belt speed. However, the feeder has the disadvantage that the blank to be decollated is always lifted off perpendicularly of the stack and, thus, with increasing speeds the flow of the air between the blank to be delivered at the moment and the residual stack becomes problematic and leads to incorrect feedings.

(c) Timed suction belt feeder

The principle of timed suction belt feeders is used most often in the devices and methods of the above-described type. When using these feeders, decollating speeds of up to 500 cycles per minute are achieved. A disadvantage of these feeders is the fact that the decollating element, i.e., the conveyor belt, acts in accordance with the cycle of the machine and, thus, always acts on the blank in accordance with the machine belt speed. The adjustment of the movement of the timed lifting unit to the respective length of the blanks is also difficult.

The above-described principle is known, for example, from DE 29 46 426 C2 and has up to now made possible the highest speeds of up to 600 blanks per minute. However, the technical requirements for the control of the upward and downward movement of the conveyor belts are substantial.

In contrast to the solutions described above, a relative movement of the stack of the blanks and the conveyor belts is not used in the timed suction belt feeder according to DE 38 11 988 C2. Instead, the feeder belts are driven intermittently. The speed of these feeders is limited because substantial masses must be moved. The technical requirements and the wear of the device are also disadvantages. The system has not been widely accepted in practice.

SUMMARY OF THE INVENTION

In view of the prior art discussed above, it is the primary object of the present invention to provide a method and an apparatus for an automatic decollating of blanks and feeding the blanks to a cyclically operating subsequent process, particularly a production plant for folding boxes with foil windows, in which the disadvantages and difficulties described above are avoided. The method and apparatus are to be uncomplicated and should facilitate significant production increases, while being simple to operate and of simple construction, so that the costs for manufacturing, assembling and maintaining the apparatus are drastically reduced.

Another object of the present invention is to make possible a simple regulation and adjustment for a uniform alignment of the blanks of feeding stations arranged next to each other.

In accordance with the present invention, the transfer station of the subsequent process controls the speed of the delivery conveyor which operates without fixed cycle.

In accordance with an advantageous further development of the invention, feeding of the blanks into the subsequent process which operates in accordance with a fixed cycle is effected through an electronic control of the speed of the belt of the delivery conveyor in dependence on the length of the blanks, the distance between the blanks and a desired/actual comparison of the relative position of the respective front edge to the reference position of the subsequent process.

Two different Control Principles are Possible

- determining the position of the front edge of the blank travelling toward the transfer station relative to the desired position and subsequently, if necessary, influencing the speed of the conveyor belt with the object of correcting the relative position of the following blank;
- determining the position of the front edge of the blank travelling toward the transfer station relative to the desired position and, subsequently, if necessary, influencing the speed of the conveyor belt with the object of placing the relative position of the measured blank into the desired position prior to reaching the delivery rollers.

The present invention particularly provides that the control of the relative position of the respective front edge of a blank decollated from the stack of blanks to the theoretical desired position takes place in relation to the subsequent process, wherein the front edges of the blanks always reach the delivery rollers at the cyclically returning moment of the subsequent process, wherein the front edge of the blank is detected by an electronic scanner prior to reaching the delivery rollers.

In accordance with another development of the invention, in the case of several blanks which are arranged next to each other and are to be supplied in parallel to a common subsequent process, the speeds of the conveyor belts assigned to the parallel blanks are controlled separately.

The method according to the present invention is particularly advantageously used in machines for gluing windows e.g. into envelopes or boxes or the like.

In accordance with the invention, devices for carrying out decollating in accordance with a machine cycle are not used at all and initially the most common device for continuous decollating of a belt feeder is used. This results in the optimum ratio of the speed of the decollating element acting on the blank (conveyor belt) to the speed achieved immediately after decollating the blank. For this reason, decollating speeds of up to 1200 blanks per minute are achieved. Moreover, complicated mechanical and electromechanical machine components for decollating are replaced by simple and inexpensive mass-produced articles.

The apparatus according to the present invention for meeting the above-described object includes an electronic control for controlling the speed of the belt of the delivery conveyor in dependence on the length of the blanks, the distance between the blanks and a desired/actual comparison of the relative position to the reference position of the subsequent process.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DESCRIPTION OF THE PREFERRED EMBODIMENTS

Figure 1:
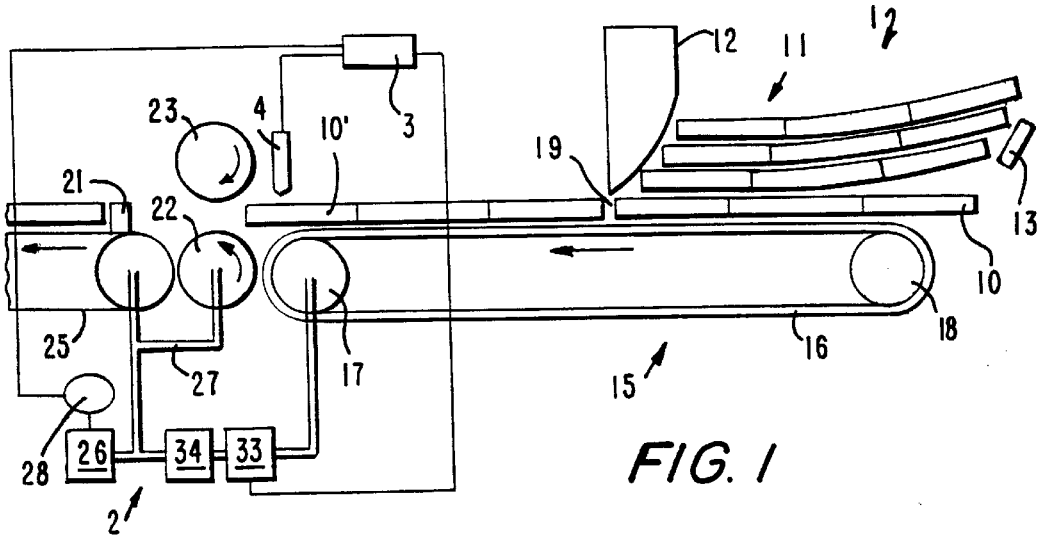
FIG. 1 is a schematic side view of an apparatus according to the present invention for decollating stacked blanks and for delivering the blanks to a subsequent process.
Figure 2:
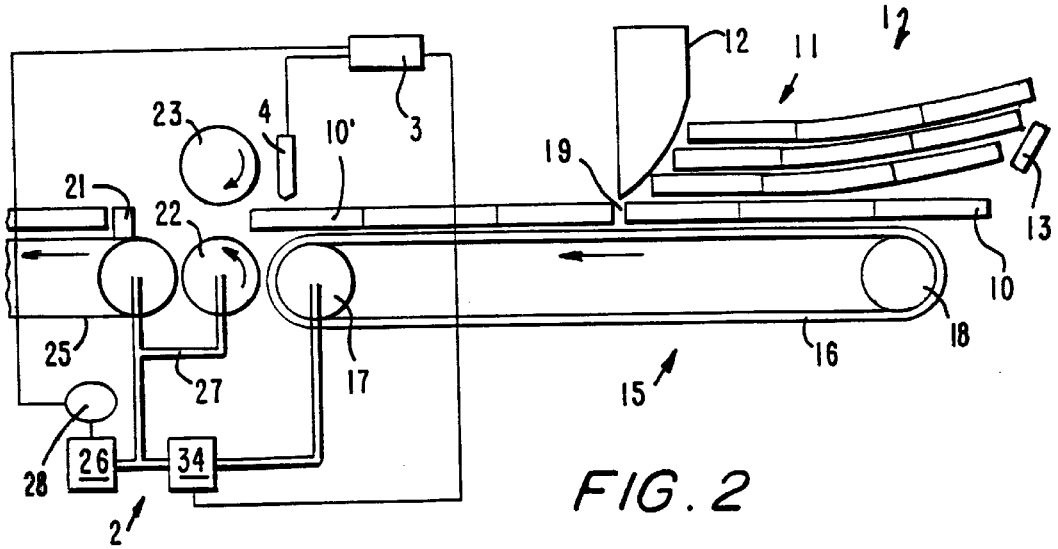
FIG. 2 is a view corresponding to FIG. 1, showing the apparatus without adjusting gear system.
Figure 3:
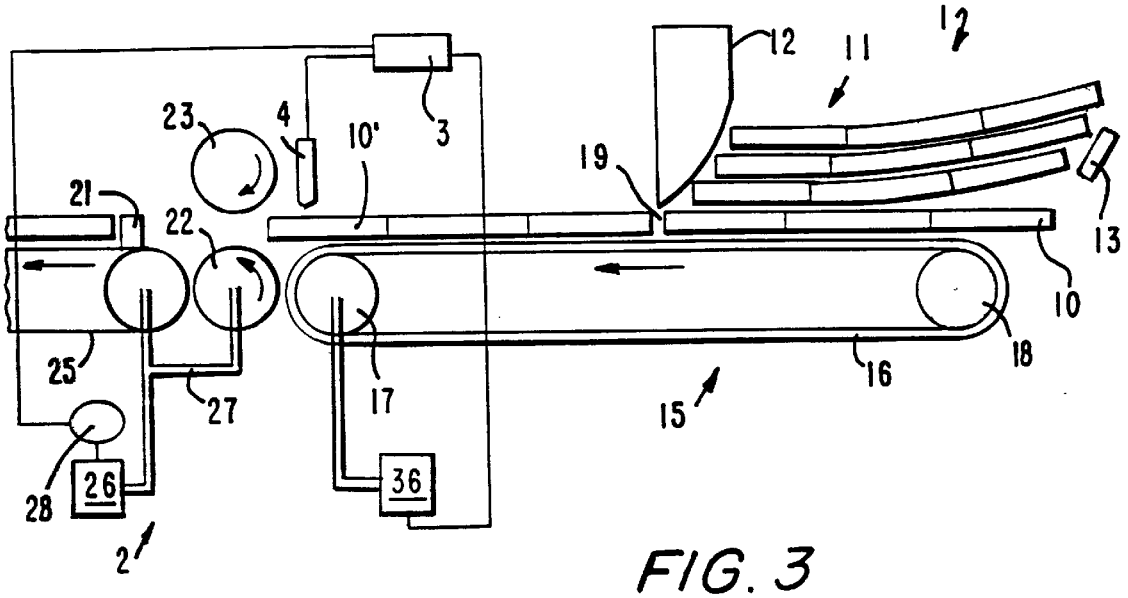
FIG. 3 is a view corresponding to FIG. 2, shown without control gear system, but with separate drive.

As illustrated in FIGS. 1 to 3, blanks 10 are fed in a feeding station 1 from a magazine or stack 11 of blanks located between a stop 12 and a blank support member 13 into a subsequent process 25 operated in a timed manner, specifically into the transfer station 2 of the subsequent process 25, controlled by the electronic control 3 of the speed of the input or conveyor belt 16 of the delivery conveyor 15 or the guide rollers 17, 18 thereof in dependence on the length of the blanks and the distance 19 between the blanks, such that the front edges 10' of the blanks 10 always reach the withdrawal rollers 22, 23 at a cyclically returning moment of the subsequent process 25. For this purpose, the front edge 10' of each blank 10 is detected by an electronic scanner 4 prior to reaching the withdrawal rollers 22, 23. The withdrawal rollers 22, 23 accelerate the blank 10' to the speed of the belt of the subsequent process 25, for example, an aligning chain with aligning ledges 21.

The subsequent process 25, or the guide roller thereof, is driven by a mechanical connection to the drive 26. According to a particularly useful feature, separate withdrawal rollers 22, 23 are provided which are coupled with respect to their drives through a direct coupling 27 with the drive 26 for the subsequent process 25.

As illustrated in FIG. 1, the drive of the conveyor belt 16 is connected through the control gear unit 34 and the adjusting gear unit 33 to the drive 26 of the subsequent process 25. The control gear unit 34 compensates the speed difference due to the length of the blank 10' and the average distance 19 between the blanks 10 relative to the duration of the cycle of the subsequent process 25. The adjusting gear unit 33 is controlled by the electronic control 3 and compensates the deviation of the average relative position of the front edge 10' of each blank 10 to the reference position in relation to the subsequent process 25. The reference position of the subsequent process 25 is taken from the encoder or incremental pickup 28.

In accordance with the embodiment of FIG. 2, it is also possible to omit the adjusting gear unit 33 and to have the electronic control 3 act directly on the control gear unit 34.

In accordance with the embodiment of FIG. 3, the control gear unit 34 can also be omitted. In that case, the drive of the conveyor belt 16 is effected through a directly controllable electric motor 36 which, on the basis of the data of the encoder 28 and the measurement of the electronic scanner 4, controls by means of an electronic control the speed in such a way that the respective front edges 10' of the blanks 10 reach the withdrawal rollers 22, 23 at the correct moment.

The features and further developments of the present invention are not limited to the embodiments illustrated in the drawing. The apparatus according to the present invention may be modified by providing, for example, several control circuits. Those skilled in the art are free to carry out structural modifications in accordance with special requirements.

The invention is not limited by the embodiments described above which are presented as examples only but can be modified in various ways within the scope of protection defined by the appended patent claims.

We claim:

1. A method of decollating stacked blanks of cardboard from a stack of blanks arranged behind a stop in a feeding station, the method comprising carrying out a controlled removal of a respective lowermost blank of the stack of blanks through a delivery conveyor with conveyor belt and belt guide means arranged under the stack of blanks, conveying the blank to a subsequent process with a transfer station operating in a timed manner, the delivery conveyor operating in a non-timed manner, wherein the transfer station of the subsequent process comprises means for controlling the speed of the delivery conveyor, further comprising carrying out feeding of the blanks into the subsequent process by an electronic control of the speed of the belt of the delivery conveyor in dependence on a length of the blanks, a distance between the blanks and a desired/actual comparison of a relative position of a front edge of the blank to a reference position of the subsequent process.

2. The method according to claim 1, comprising using the method in a machine for gluing windows.

3. The method according to claim 1, comprising carrying out the control of the relative position of the front edge of a blank decollated from the stack of blanks to a theoretical desired position in relation to the subsequent process, so that the front edges of the blanks always reach withdrawal rollers of the delivery conveyor at a cyclically returning moment of the subsequent process, further comprising detecting the front edge of each blank by an electronic scanner prior to the blank reaching the withdrawal rollers.

4. The method according to claim 1, comprising feeding a plurality of blanks arranged next to each other parallel to a common subsequent process, comprising separately controlling speeds of conveyor belts for conveying the blanks arranged next to each other.

5. An apparatus for decollating blanks of cardboard stacked behind a stop in a feeding station from a stack of blanks, the apparatus comprising at least one delivery conveyor arranged underneath the stack of blanks, the delivery conveyor comprising a conveyor belt and a belt guide means for delivering in a controlled manner a respectively lowermost blank of the stack of blanks and conveying the blank to a subsequent process with a transfer station operating in a timed manner, further comprising an electronic control for controlling a speed of the belt of the delivery conveyor in dependance on a length of the blanks, a distance between the blanks and a desired/actual comparison of a relative position of a respective front edge of the blank relative to a reference position of the subsequent process.

6. The apparatus according to claim 5, further comprising withdrawal rollers mounted between the delivery conveyor and the subsequent process and an electronic scanner for detecting the front edge of each blank prior to reaching the withdrawal rollers.

7. The apparatus according to claim 6, comprising means for mechanically connecting a drive of the subsequent process to a drive unit, and means for directly coupling a drive of the withdrawal rollers to the drive of the subsequent process.

8. The apparatus according to claim 7, wherein the conveyor belt of the delivery conveyor is mounted so as to be driven by a directly controllable electric motor.

9. The apparatus according to claim 7, comprising means for connecting the conveyor belt of the delivery conveyor through a control gear unit to the drive unit.

10. The apparatus according to claim 7, wherein the conveyor belt of the delivery conveyor is connected through a control gear unit and an adjusting gear unit to the drive unit.

* * * * *